United States Patent [19]

Johnston

[11] 3,964,384

[45] June 22, 1976

[54] HIGH SPEED PRINTING MECHANISM

[75] Inventor: Ross W. Johnston, Norristown, Pa.

[73] Assignee: Sperry Rand Corporation, Blue Bell, Pa.

[22] Filed: Mar. 11, 1974

[21] Appl. No.: 450,123

[52] U.S. Cl. ..... 101/93.48; 101/93.29; 101/93.02

[51] Int. Cl.[2] ..... B41J 9/02

[58] Field of Search ..... 101/93.14, 93.28–93.34, 101/93.02, 93.48

[56] References Cited

UNITED STATES PATENTS

| | | | |
|---|---|---|---|
| 3,385,211 | 5/1968 | Shepard | 101/93.33 |
| 3,426,675 | 2/1969 | Dalton | 101/93.02 X |
| 3,490,366 | 1/1970 | Benson et al. | 101/93.33 |
| 3,507,213 | 4/1970 | Derc | 101/93.02 |
| 3,635,156 | 1/1972 | Krebs et al. | 101/93.33 |
| 3,726,213 | 4/1973 | Herbert | 101/93.02 X |
| 3,745,917 | 7/1973 | Cavella | 101/93.34 |
| 3,795,187 | 3/1974 | Babler | 101/93.3 X |

*Primary Examiner*—Edgar S. Burr
*Assistant Examiner*—Edward M. Coven
*Attorney, Agent, or Firm*—John B. Sowell

[57] ABSTRACT

A plurality of small pin-shaped low-mass print hammers are slideably mounted in a row opposite moving type. The low-mass print hammers are individually moved a short distance from a ready position to impact the moving type by individual highspeed actuators when a selected character is juxtaposed each of the hammers. The print hammers and actuators are returned to the ready position by spring means cooperating with damper means.

2 Claims, 3 Drawing Figures

FIG. 1
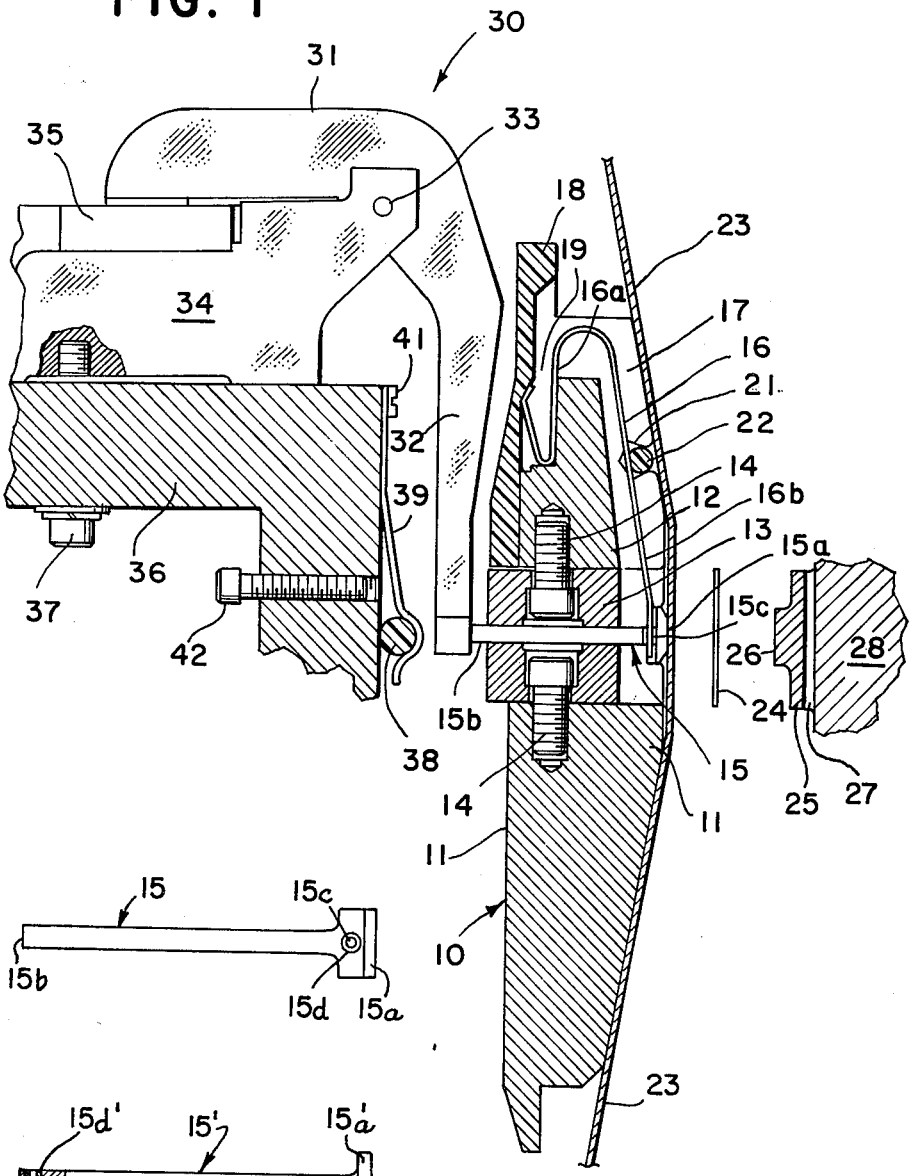
FIG. 2
FIG. 3
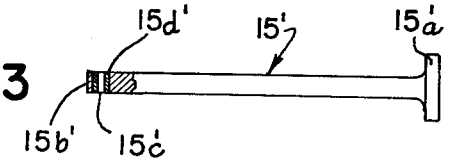

HIGH SPEED PRINTING MECHANISM

BACKGROUND OF THE INVENTION

1. Field of the Invention

This invention relates to improvements in impact printing mechanisms. The improvements are particularly useful in high-speed line printers of the impact type. More particularly, the invention relates to low-mass fast-acting actuators cooperating with low-mass fast-acting print hammers in a novel print head assembly.

2. Description of the Prior Art

Most high-speed impact printers are designed for use as output devices in computing systems. High-speed impact line printers are usually operated by electrical signals originating from a computer or auxiliary equipment to energize actuators which cause print hammers to strike a moving record medium. One class of high-speed impact printers are of the back-printing type wherein type characters are provided on a drum, disk or belt which is moved behind the record medium on which printing is to be effected. Usually an individual type hammer is provided for each of the columns to be printed, and the type hammer is timed to strike or impact the front of the moving record medium when a selected character on the type carrier is opposite the print hammer to effect printing on the moving record medium.

One example of a high-speed impact printer for back printing is provided with a plurality of print hammers in a row opposite a drum on which there is provided a complete set of type on the cylindrical surface of the drum for each print hammer. Accordingly, a row of type having 130 columns would require a drum with 130 individual annular disks of type on the drum. Such drums are expensive and are difficult to balance for high-speed rotation. Heretofore, the fastest rigid type carrier has been limited to speeds below three hundred inches per second.

A single annular disk of type such as that employed on a drum may be placed on a moving frame opposite a single print hammer and traversed across a complete row of type columns to achieve line printing at substantially reduced speeds (usually below a hundred lines per minute).

Impact printers employing moving type require that the print hammer strike the moving record medium and retract immediately to avoid smears caused by the movement of the type and the record medium. When a single disk of type is moved opposite a single print hammer, the type carrier must make one revolution for each columnar position, thus limiting the line printing speed. Band type carriers are arranged to traverse a complete row of type columns each revolution but have other limitations.

When moving type is mounted directly on a high-mass carrier such as a print drum or a print disk, a high-mass hammer may be employed without causing vibrations of the type carrier and it is possible to effect relatively long contact times. When a low-mass flexible band or tape is employed as the type carrier, the band moves on an air film over the surface of the anvil or backup guide which requires the print hammer to force the type carrier through the air film before sufficient pressure is applied to the type to cause printing on a multiple copy record medium. Band type carriers create an air film condition which requires longer contact time than drum type carriers. Increases in contact time increases the tendancy to smear which is normally compensated for by lower speeds. As a general rule, the contact time required for a band type carrier is greater than the contact time for a drum type carrier, and heretofore band type carriers have not been employed in high-speed printers.

SUMMARY OF THE INVENTION

There is a continuing need to provide impact printing mechanisms for line printers which will produce multiple copy visual record media because computers can produce signal data at speeds far in excess of known printing speeds. Known high-speed line printers are large, expensive, complex and difficult to maintain and repair.

Accordingly, it is a primary object of the present invention to provide a reliable high-speed impact printing mechanism that is small, inexpensive to manufacture, maintain and repair.

It is another object of the present invention to decrease the time of contact between the moving type and a moving record media by employing low-mass print hammers moved at very high free-flight speeds.

It is another object of the present invention to provide a high-speed impact printing mechanism capable of operating with a moving band type carrier having velocities up to four hundred inches per second.

It is another object of the present invention to provide low-mass print hammers capable of creating high inertia impact forces.

It is another object of the present invention to provide low-mass fast-acting return spring means cooperable with the low-mass print hammers.

It is yet another object of the present invention to provide a novel print hammer assembly capable of line printing speeds up to and including three thousand lines per minute.

In accordance with these and other objects of the present invention there is provided a row of low-mass print hammers each individually movable by its own actuator when a desired character on a flexible band type carrier is opposite each of the print hammers. Each low-mass print hammer is driven by a high-speed actuator to create high inertia forces at the time of impact with the type carrier. Damped low-mass cantilever springs are provided to rapidly return the low-mass print hammers to their normal ready position.

BRIEF DESCRIPTION OF THE DRAWINGS

FIG. 1 is a section in an elevation view taken through the print hammer assembly and showing the relative position of one of the actuators;

FIG. 2 is an enlarged plan view of one of the preferred embodiment low-mass print hammers;

FIG. 3 is an enlarged elevation view of a modified embodiment low-mass print hammer.

DETAILED DESCRIPTION OF THE INVENTION

Referring now to FIG. 1, a print head assembly 10 is adapted to be mounted on the frame of the line printer (not shown). The lower hammer mount 11 and the upper mount 12 form a split frame assembly each having a split bearing half 13 mounted by screws 14 thereon. Low-mass print hammers 15 are slideably mounted and guided in bearing 13 to provide friction free hotizontal movement. Such hammers 15 are preferably made of steel for long life and mounted in self-lubricating bearing material 13 such as OILITE.

In the preferred embodiment shown, a low-mass print hammer 15 is provided at each columnar position. It is normal to have over one-hundred columns spaced ten to the inch providing normal OCR-A or OCR-B size type. The preferred embodiment print hammer shown has a mass of less than one-half gram and is driven at velocities around two hundred inches per second to provide impact forces around thirty pounds in conjunction with type font on bands moving at speeds up to four hundred inches per second. In one embodiment the type font was moved at 360 inches per second, and line printing speeds were obtained from 2200 to 3500 lines per minute.

Upper hammer mount 12 is provided with slots to receive cantilever springs 16. Each of the slots (unnumbered) is separated by a spacer 17 which gives the appearance of a comb to upper hammer mount 12. A comb plate 18 is abuttingly attached to upper hammer mount 12 and is provided with slots (unnumbered) formed by webs or teeth 19. The slots in the comb plate 18 are step-shaped to receive therein the fixed end 16*a* of spring 16. The free end 16*b* of cantilever spring 16 may be engaged in springguide means 15*c* at the head 15*a* of print hammer 15, then snapped into the step-shaped comb slots. Since the print head 10 is a split assembly, other methods of assembling the springs 16 and hammers 15 are available.

A dove tailed groove 21 in upper hammer mount 12 receives a round resilient plastic damper 22. When the hammer 15 is driven toward the multiple record medium 23 from its rest position, the actuator 30 disengages the rear end 15*b* of the hammer permitting free flight of hammer 15. At, or shortly after the time free flight occurs, the spring 16 engages front damper 22 and causes the free end 16*b* of spring 16 to bend, thus decelerating the hammer 15 while building up a return force. Since the free end of the cantilever spring has a low-mass and the print hammer has a low-mass, the print hammer will successively impact the moving record medium 23, the ribbon 24 (if provided) and the type font 26 on flexible band 25. The flexible band will be moved through air film 27 to engage the anvil or backup guide 28. The total distance the hammer 15 travels in compressing the record 23, the ribbon 24 and the tape carrier 25 is approximately two hundredths of an inch, thus it will be understood that the stroke is extremely short and that the distances represented in the drawings are exaggerated to better illustrate the invention. The type carrier 28 may be moved relative to the print head 15*a* to allow for change in thickness of the record medium or to change the print hammer stroke.

Spring 16 is designed to be strong enough to return print hammer 15 and actuator 30 to the normal rest position. As best shown in FIG. 2, hammer 15 is provided with an enlarged impact head 15*a* having an aperture 15*c* therein fitted with friction resistant plastic 15*d* to provide a bearing guide means for the rod or wire-shaped free end 16*b* of a cantilever spring 16. It will be understood that other shaped guide means and springs could be employed but would probably increase the effective mass of the print hammer 15 and spring 16.

FIG. 3 shows a modified print hammer 15′ having the aperture 15*c′* and guide means 15*d′* at the rear end 15*b′* of the print hammer. The mass of the print hammer 15′ could be decreased for this modification which would require that the upper hammer mount 12 and comb plate 18 be reversed to accommodate the spring.

Actuator 30 comprises a lever having a force arm 31 and a moment arm 32, the end of which loosely engages the rear end 15*b* of print hammer 15. Actuator 30 is provided with an electrical coil 35 mounted on frame 36 which is mounted on the print head frame 36 and held by screw 37.

Spring 39 is mounted by screws 41 on frame 36. Adjustment screw 42 permits spring 39 which embraces rear damper 38 to set or determine the rest position for the print hammer 15 and lever 32. Spring 39 may comprise a comb-shaped spring having a plurality of individual springs 39, one for each print hammer and each cooperating actuator. Other actuators and other rear dampers could be employed with the subject of this invention. The adjustment screw 42 illustrated shows one method of adjusting the throw of the moment arm 32 which determines the hammer velocity and impact force. Other methods are known to those skilled in the art. Since the hammers and return springs are uniform and of low-mass, the required return force is much smaller than the impact force. The adjustment as well as maintenance is virtually nil because the free flight distance and force once adjusted does not change.

The above described impact line printer is capable of speeds of over three thousand lines per minute and is accomplished without the usual increase in cost and complexity which accompanies attempts to increase speeds. Moreover, the invention employs a single moving flexible band of type which may be replaced inexpensively and rapidly by personnel using the printer. The desirable high-speed results were achieved by reducing the mass of the moving parts and reducing the time of contact between the type and the record medium without decreasing the impact forces required for good visual printout. Although the printer assembly is extremely reliable at line printing speeds up to four thousand lines per minute, it may be used at slower printing speeds without modification. Since the printhead assembly is designed as an intregal replaceable unit, it's low-cost and reliability enhance its adaptability in printing devices at speeds as low as four hundred lines per minute.

What is claimed is:

1. A high-speed impact printing mechanism having a free flight hammer adapted to be moved from a ready position toward a predetermined type character on juxtaposed moving type to a free flight impact position comprising:

hammer mounting means, bearing means supported on said hammer mounting means, hammer means slidably mounted in said bearing means opposite said moving type, impact head means on said hammer means, guide means on said hammer means, actuator means adapted to move said hammer means from said ready position toward said moving type and to a free flight impact position when a selected type character is juxtaposed said hammer means, cantilever spring means mounted at a fixed end on said hammer mounting means and having a free end slidably guided in said guide means, said cantilever spring means being normally spring loaded to return said hammer means and said actuator means to a ready position, and front damper means mounted on said hammer mounting means for engaging a short portion of said cantilever spring means intermediate said free end and said fixed end effectively providing a shortened cantilever spring between said hammer means and said damper means when said hammer means is moved from said ready position to said free flight impact position by said actuator means, whereby said free end of said cantilever spring means is damped, its natural frequency is raised and the initial return force of said spring means on said hammer means is increased.

2. A high-speed printing mechanism as set forth in claim 1 which further includes a print frame and rear damper means mounted on said print frame to juxtapose the rear of said hammer means, with a portion of said actuator means there between for damping the rearward movement of said hammer means from said free flight impact position to said ready position, said rear damper means comprising a combshaped spring mounted on said print frame and cooperating with a resilient damper and screw means for adjusting the position of said combshaped spring against said actuator means to position said hammer means in said ready position.

* * * * *